US006189521B1

(12) United States Patent
Hancock

(10) Patent No.: US 6,189,521 B1
(45) Date of Patent: Feb. 20, 2001

(54) COMPOSITE ENGINE INTAKE MODULE HAVING INTEGRATED COMPONENTS FOR HANDLING GASEOUS FLUIDS

(75) Inventor: Robert Laurence Hancock, Ann Arbor, MI (US)

(73) Assignee: Visteon Global Technologies, Inc., Dearborn, MI (US)

( * ) Notice: Under 35 U.S.C. 154(b), the term of this patent shall be extended for 0 days.

(21) Appl. No.: 09/407,157

(22) Filed: Sep. 28, 1999

(51) Int. Cl.[7] ..... F02B 25/06
(52) U.S. Cl. ..... 123/572; 123/184.61; 123/184.47
(58) Field of Search ..... 123/572, 574, 123/184.61, 184.47

(56) References Cited

U.S. PATENT DOCUMENTS

| | | | | |
|---|---|---|---|---|
| 4,615,324 | | 10/1986 | Choushi et al. | 123/568 |
| 4,656,991 | * | 4/1987 | Fukuo et al. | 123/572 |
| 4,715,329 | | 12/1987 | Yasuda et al. | 123/52 MV |
| 4,867,109 | | 9/1989 | Tezuka et al. | 123/52 MB |
| 5,005,535 | | 4/1991 | Binversie et al. | 123/52 M |
| 5,209,191 | | 5/1993 | Kopec | 123/52 MC |
| 5,307,785 | | 5/1994 | Yoshikawa | 123/635 |
| 5,357,931 | | 10/1994 | Semence | 123/456 |
| 5,477,819 | | 12/1995 | Kopec | 123/184.42 |
| 5,664,533 | | 9/1997 | Nakayama et al. | 123/184.42 |

* cited by examiner

*Primary Examiner*—Tony M. Argenbright
*Assistant Examiner*—Katrina B. Harris
(74) *Attorney, Agent, or Firm*—Rhonda L. McCoy-Pfau

(57) ABSTRACT

An internal combustion engine intake module (10; 60) integrates elements of a PCV system, including a PCV valve (40) and a channel, or conduit, (102) for conveying gaseous fluid.

11 Claims, 6 Drawing Sheets

COMPOSITE ENGINE INTAKE MODULE HAVING INTEGRATED COMPONENTS FOR HANDLING GASEOUS FLUIDS

BACKGROUND OF THE INVENTION

1. Field of the Invention

This invention relates to internal combustion engines, and particularly to a composite engine intake module having certain integrated components, including elements of a positive crankcase ventilation (PCV) system and a conduit for conveying gaseous fluid, such as engine-generated gases.

2. Background Information

Spark-ignited, fuel-injected internal combustion engines enjoy extensive usage as the powerplants of automotive vehicles. In a representative piston engine, an intake manifold conveys intake air to intake valves of engine combustion cylinders. The intake valves are normally closed but open at certain times during the operating cycle of each cylinder. Pistons that reciprocate within the engine cylinders are coupled by connecting rods to a crankshaft. When the intake valves are open, fuel, such as gasoline, is sprayed by electric-operated fuel injectors into intake air entering the cylinders, creating charges of combustion gases that pass through the open intake valves and into the combustion cylinders. After the intake valves close, the charges are compressed by the pistons during compression strokes and then ignited by electric sparks at the beginning of power strokes to thereby drive the pistons and power the engine.

Continuing developments in materials and processes have enabled engine intake manifolds to be fabricated in ways that differ significantly from historical methods involving metal casting and machining. The ability to fabricate engine intake manifolds, or modules, using newer processes offers a number of benefits, including for example and without limitation: opportunities to structure engine intake modules in novel configurations for design and/or functional purposes; realization of fabrication and assembly cost savings; shorter lead times from design to production; and more efficient use of engine compartment space in an automotive vehicle.

An engine or vehicle manufacturer may be able to attain even further productivity improvements through increased integration of individual component parts in engine intake modules. For example, an intake module that efficiently integrates conduits for conveying gaseous fluids may offer potential for significant productivity improvements. Such integration can eliminate what would otherwise be individual parts that have to be assigned individual part numbers and that have to be assembled to an intake manifold; it may also contribute to the aesthetic appearance of an engine compartment, which is typically quite crowded. Convenient and expedient access to certain serviceables and consumables may be an important objective in the design of an engine compartment, and the organization and arrangement of an intake module can play a significant role in attaining that goal.

SUMMARY OF THE INVENTION

One general aspect of the present invention relates to a composite intake module in which elements of the engine's positive crankcase ventilation (PCV) system are integrated.

Another general aspect relates to a composite intake module in which a conduit for conveying gaseous fluid is integrated.

A general aspect of the within claimed invention relates to an internal combustion engine intake module comprising: composite elements forming at least a portion of an air intake system for an engine and a walled chamber of a PCV system for the engine; a mounting receptacle for a PCV valve within the chamber; a PCV valve disposed in the mounting within the chamber and comprising an inlet adapted to be communicated, via an entrance to the chamber, to a crankcase of the engine, and an outlet adapted to be communicated, via an exit from the chamber, to engine vacuum created when the engine is running; and a removable cap closing a through-hole in a wall of the chamber via which the PCV valve can be removed when the cap is removed from the through-hole.

Another general aspect relates to an internal combustion engine intake module comprising: composite elements joined together to form at least a portion of an air intake system for an engine; a first and a second of the composite elements being joined together along adjoining margins; the adjoining margin of the first composite element comprising a channel bounded along its sides by respective ridges; the ridges having edges that are fused with the adjoining margin of the second composite element to create an internal conduit within the module for conveying gaseous fluid; and an entrance to, and an exit from, the conduit spaced apart along the conduit length.

Other general and more specific aspects will be set forth in the ensuing description and claims.

BRIEF DESCRIPTION OF THE DRAWINGS

The drawings that will now be briefly described are incorporated herein to illustrate a preferred embodiment of the invention and a best mode presently contemplated for carrying out the invention.

DESCRIPTION OF THE PREFERRED EMBODIMENT

Figure 1:
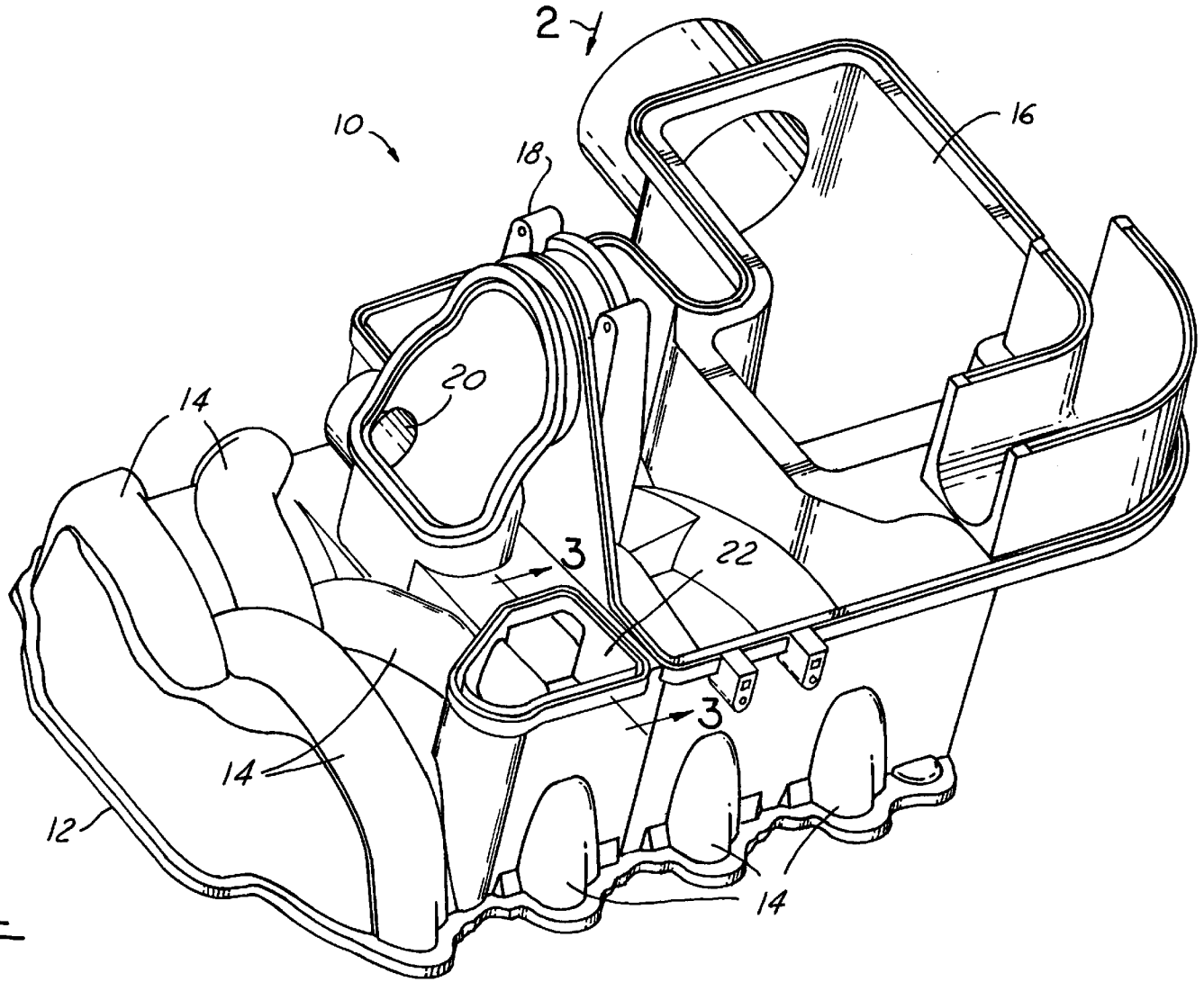
FIG. 1 is a perspective view of one shell of an engine intake module by itself.
Figure 3:
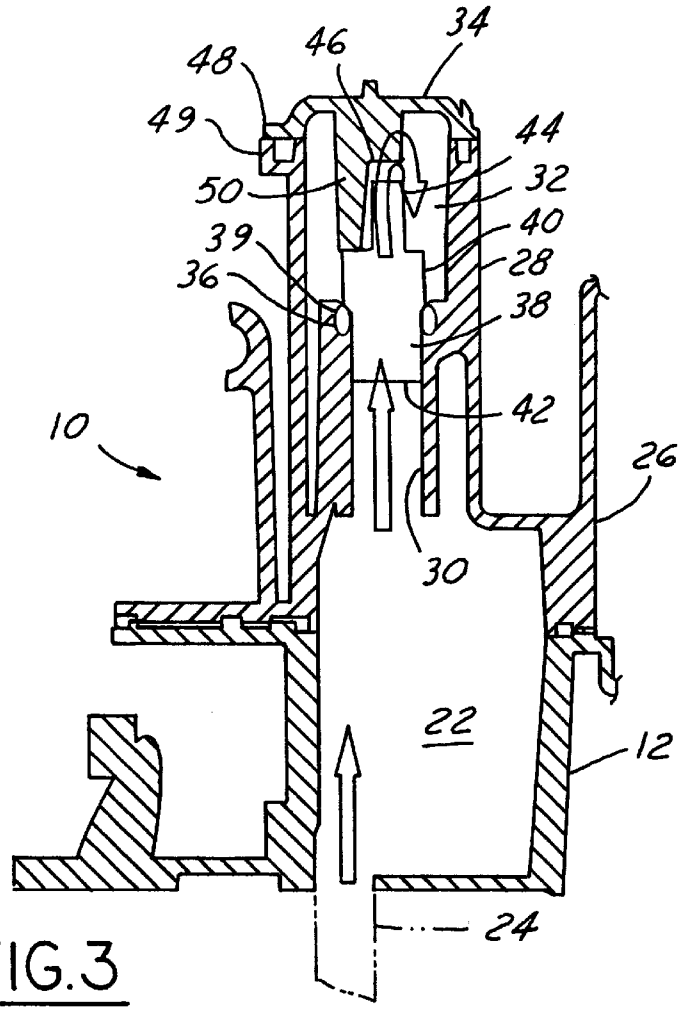
FIG. 3 is cross section view in the general direction of arrows 3—3 in FIG. 1 showing additional elements of a PCV system.
Figure 2:
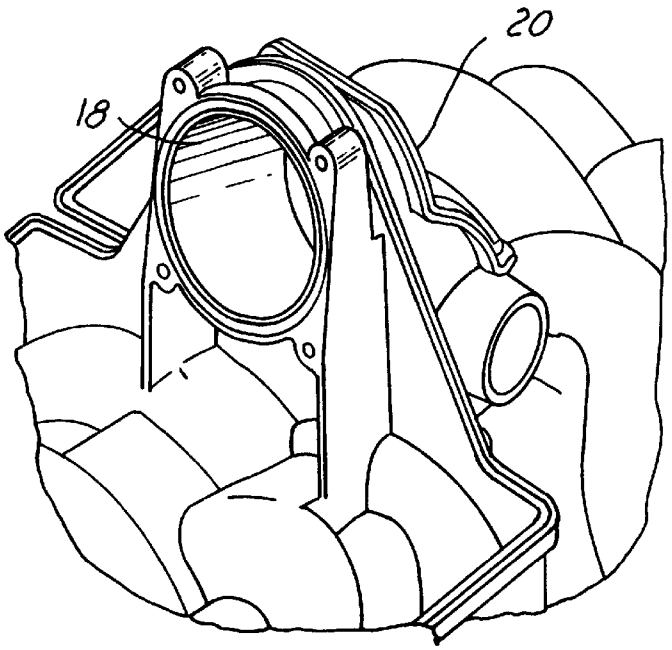
FIG. 2 is a fragmentary perspective view in the general direction of arrow 2 in FIG. 1.
Figure 4:
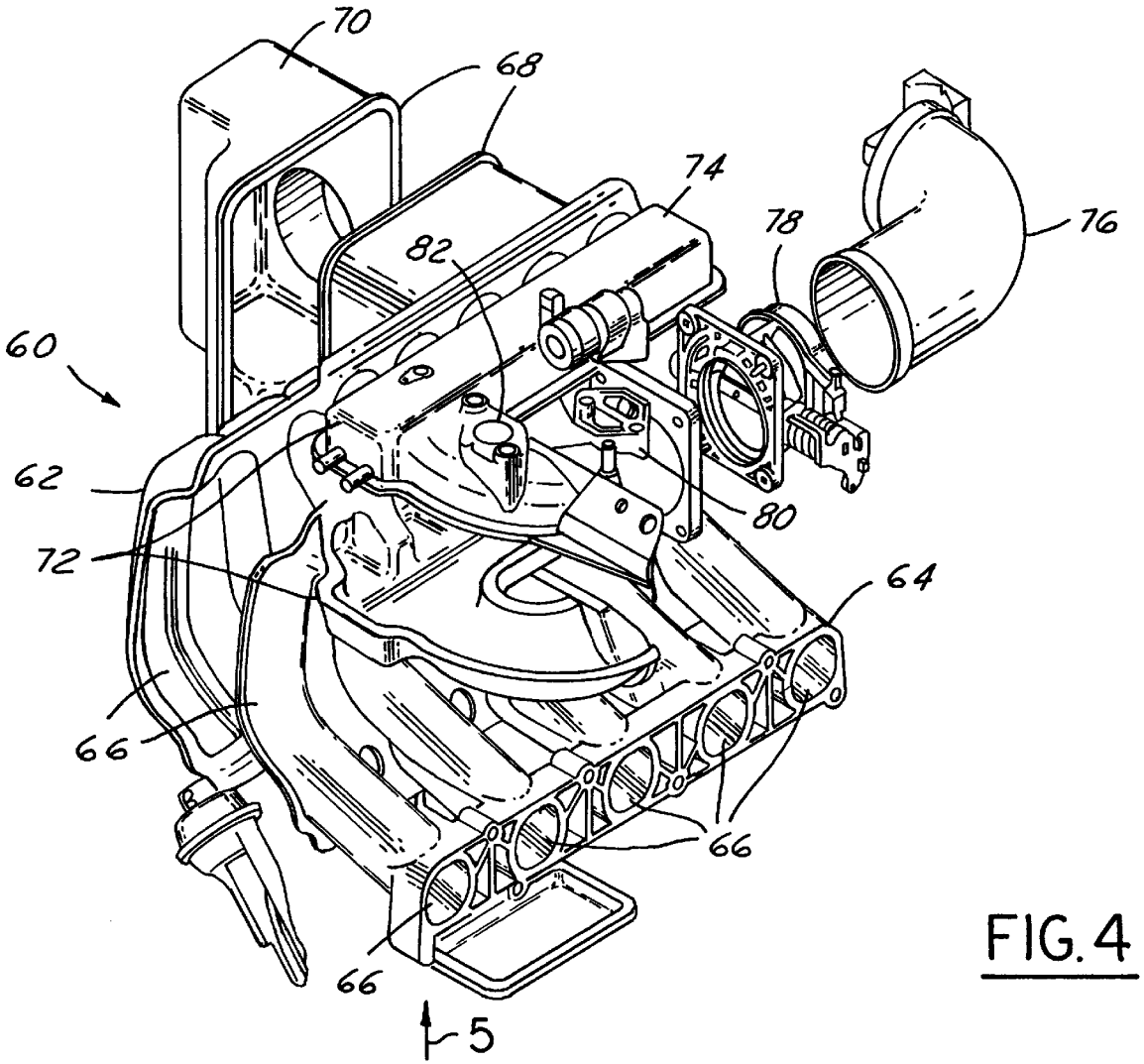
FIG. 4 is an exploded perspective view of another engine intake module, including various components associated with the module.
Figure 5:
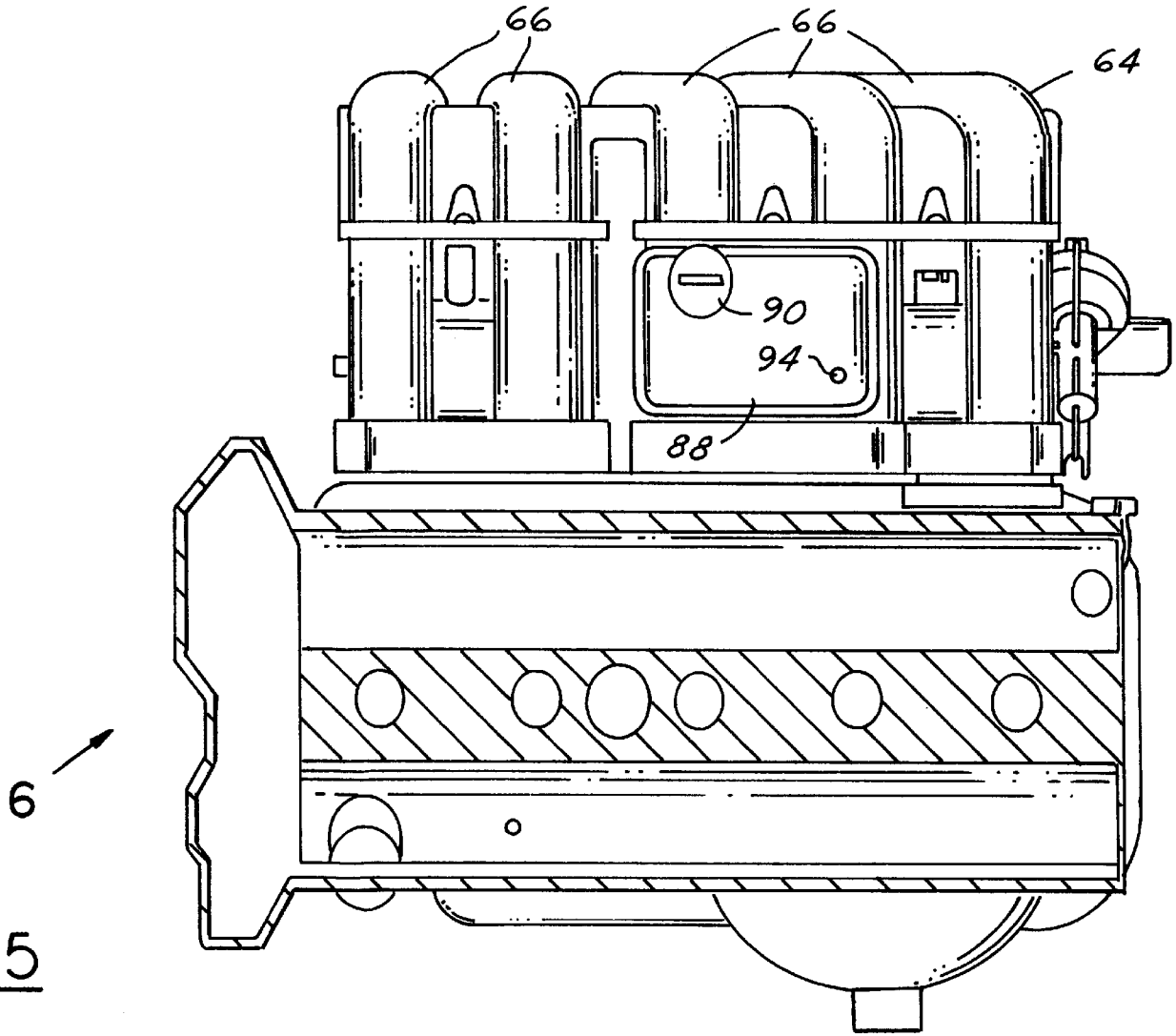
FIG. 5 is a view in the general direction of arrow 5 in FIG. 4, including a cam cover for an engine.
Figure 6:
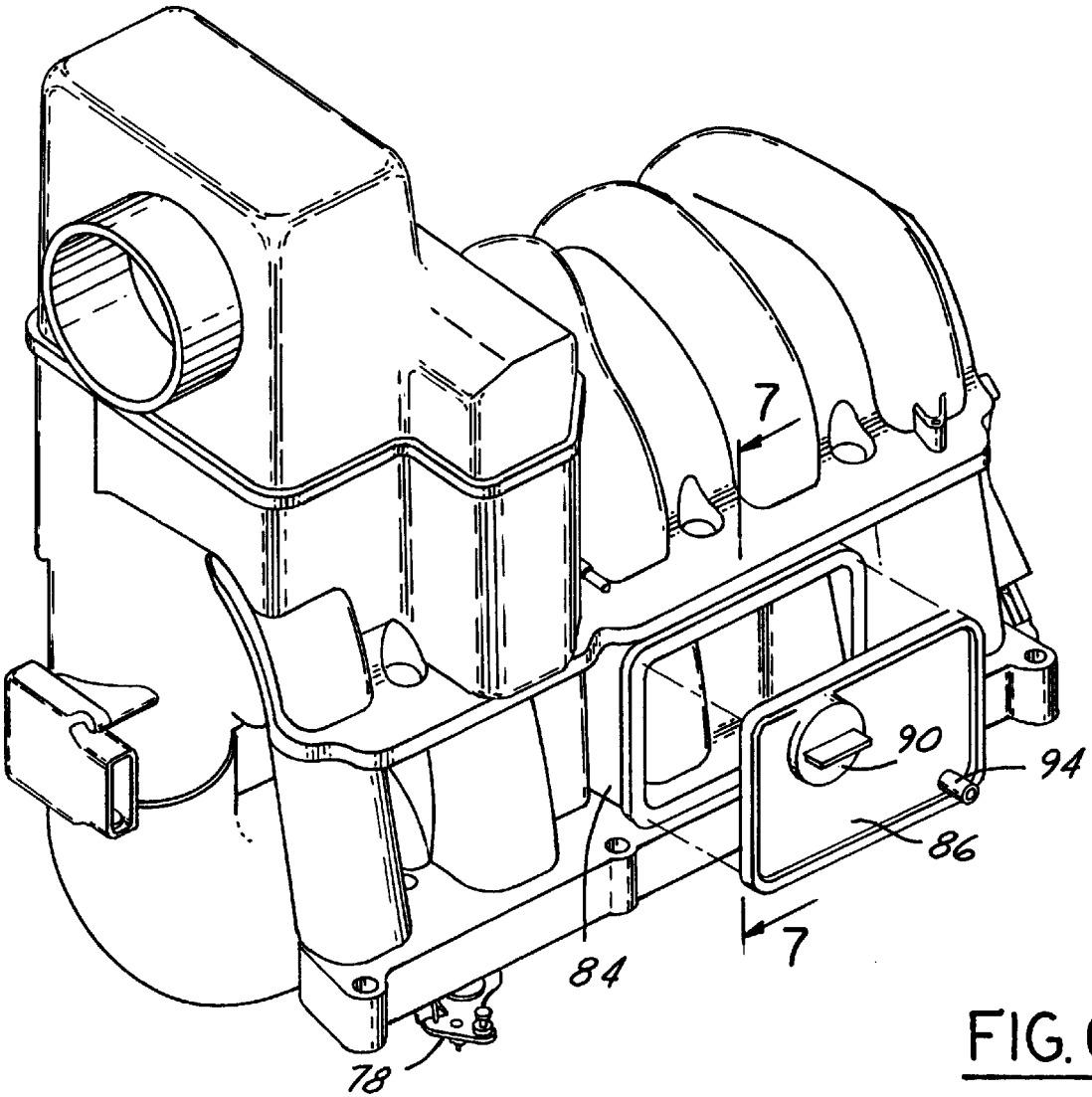
FIG. 6 is a perspective view of the module only, taken in the general direction of arrow 6 in FIG. 5.

FIGS. 1, 2, and 3 show certain components of an engine relevant to integration of certain elements of a PCV system. The engine comprises an intake module 10 one component of which is a composite shell 12. Shell 12 associates with other components (not shown) to cooperatively define cylinder runners 14, an air box 16, a throttle body mounting 18, and a connection 20 for an exhaust gas recirculation (EGR) valve. In accordance with certain principles of the present invention, shell 12 integrates a portion of the PCV system by defining a portion of a walled chamber 22 that is communicated to the camshaft/valvetrain that are below the module.

Intake module 10 is disposed in covering relation to an underlying head of the engine that contains engine intake and exhaust valves for the engine cylinders. In a V-type engine, as shown, there are two cylinder banks at opposite sides of the engine. By suitable design and mounting on the engine, module 10 can also serve as a cover for the cam/valvetrain of each cylinder bank (not shown). The engine contains internal breather passages running between each space enclosed by a valve cover and the engine crankcase. A PCV system ventilates the crankcase via these breather passages to allow fresh air at substantially atmospheric pressure to enter the crankcase at one side of the engine, scavenge gases from the crankcase, and convey the scavenged gases out of the crankcase at the other side of the engine. When a PCV valve in the PVC system opens in response to sufficient engine vacuum, fresh atmospheric air is sucked through one or more breather passages at the one side of the engine and into the engine crankcase. There the fresh air scavenges internally generated gases, including combustion blow-by gases, and the scavenged gases are sucked out of the crankcase through one or more breather passages that extend from the crankcase at the other side of the engine, and finally through the PCV valve. From there the gases are introduced into the intake air flow into the cylinders, ultimately to be combusted in the engine cylinders. Elements, such as baffles, may be disposed proximate the PCV valve to function as oil separators that allows gases, but not liquids, to pass freely through.

FIG. 3 shows that when module 10 is mounted on the engine, chamber 22 is open to a breather passage 24 that conveys scavenged gases from the crankcase. The definition of chamber 22 is completed by a cover 26 that fits on, and joins with, shell 12. Cover 26 includes a tower 28 atop chamber 22. An internal passage 30 runs upward through tower 28 from chamber 22. At its upper end, passage 30 opens to a space 32 that is closed at the top by a removable cap 34. The upper end of passage 30 contains a seat 36 for seating the cylindrical body 38 of a known PCV valve 40. A lower portion of valve body 38, including an O-ring seal 39 for sealing the valve body to seat 36, closes passage 30, but contains an inlet 42 at the lower end. Opposite inlet 42, PCV valve 40 comprises a nipple 44 that contains an outlet 46 that is open to space 32. A flow path through PCV valve 40 between inlet 42 and outlet 46 is normally closed by an internal bias spring.

Space 32 is communicated in any suitable manner to the intake air flow into the engine cylinders at a location downstream of the throttle body. During engine operation that results in sufficiently large intake vacuum, sufficient pressure differential is created between inlet 42 and outlet 46 to cause PCV valve 40 to open. Scavenged gases from the engine crankcase are drawn through chamber 22, passage 30, PCV valve 40, and space 32, and thence to entrain with the engine intake air flow.

Cap 34 comprises a perimeter margin 48 that is shown in FIG. 3 sealed to a perimeter margin 49 at the top of tower 28 to create a gas-tight joint between the cap and tower. Cap 34 can be removed from its closure of space 32 to allow PCV valve 40 to be extracted from its mounting within tower 28, and re-installed or replaced. Any conventional means of removably attaching the cap to the tower, such as a twist lock, may be employed. Near its center, the interior of cap 34 comprises a depending post 50 whose free end confronts an external shoulder of valve 40 at the base of nipple 44 when cap 34 is sealed closed on tower 28, thereby holding valve 40 in seat 36.

FIGS. 4–7 depict another embodiment on a different engine in which an intake module 60 comprises composite shells 62, 64 that are joined together to cooperatively define cylinder runners 66. An air box 68 is cooperatively defined by a portion of shell 62 and an air box cover 70. A plenum 72 is cooperatively defined by a portion of shell 64 and a plenum cover 74. An air inlet tube 76 conveys clean air from air box 68 to the inlet of a throttle body 78. The outlet of throttle body 78 conveys throttled air to the entrance of plenum 72. Plenum cover 74 contains respective mountings 80, 82 for an idle air control valve and an EGR valve (not shown) downstream of the plenum entrance.

Module 60 comprises a walled chamber 84 (see FIG. 6) analogous to chamber 22 of module 10. Chamber 84 is cooperatively defined by a portion of shell 64 and by a cover 86, which are joined together at mating perimeter margins to form a gas-tight joint 88. Cover 86 comprises a hole that is closed by a cap 90. The interior of cap 90 contains a receptacle 92 for holding PCV valve 40 in similar fashion to the manner in which the valve was held in seat 36 in module 10. However, receptacle 92 (see FIG. 7) contains one or more openings, such as holes or slots, that allow inlet 42 to be open to the interior of chamber 84 when cap 90 is closing the hole in cover 86. Cover 86 also contains a nipple 94 spaced from cap 90. A baffle 96 within chamber 84 between nipple 94 and cap 90 provides a tortuous path forming an oil separator between nipple 94 and cap 90. Because of particular design of the engine, scavenged gases from the crankcase are conveyed through an external conduit 98 from the crankcase to chamber 84 where they enter through nipple 94. Some of the elements that create the tortuous path of baffle 96 are formed in cover 86 while others are formed in shell 64. One of those elements in shell 64 may function as a post that aids in holding PCV valve 40 seated in receptacle 92 when cap 90 is closing the hole in cover 86. The formation of chamber 84 with shell 64 provides for scavenged crankcase gases that exit outlet 46 to be introduced into one of the runners 66 via a passage 100. When cap 90 is removed from cover 96, it may extract valve 40 in the process; in any event, cap 90 provides access to the interior of chamber 84 for servicing the PCV valve.

Figure 8:
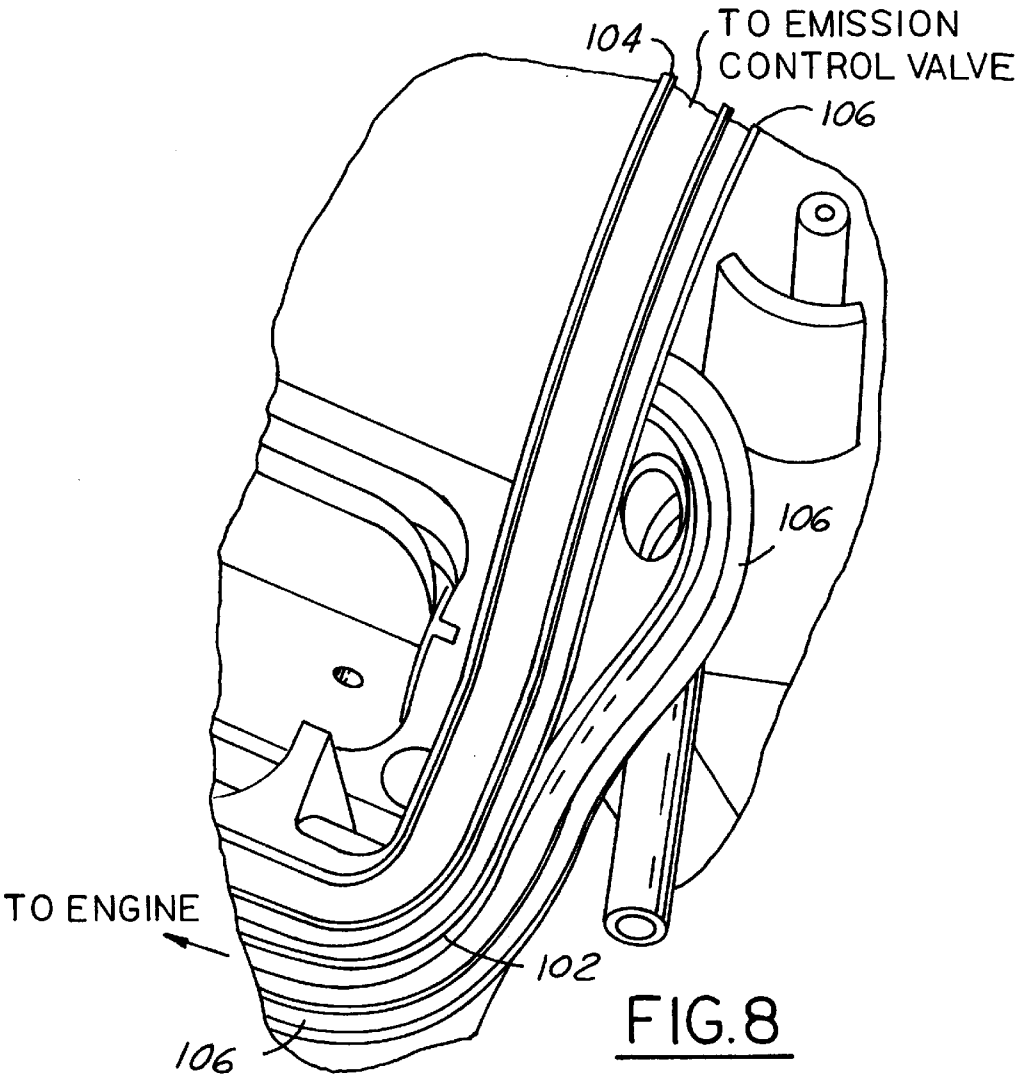
FIG. 8 is a perspective view of a portion of a module showing an integrated conduit for conveying gaseous fluid.
Figure 7:
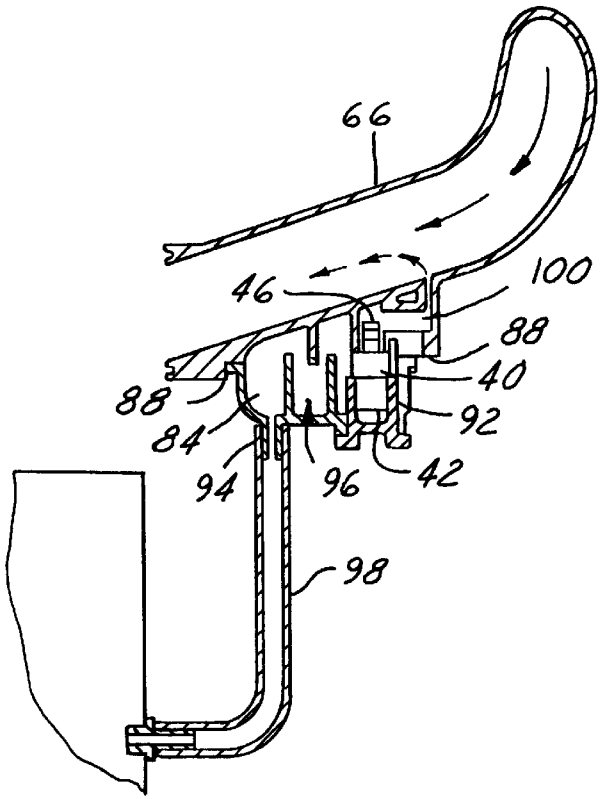
FIG. 7 is an enlarged fragmentary cross section view in the direction of arrows 7—7 in FIG. 6.

FIG. 8 shows how a conduit for conveying a gaseous fluid can be integrated in an engine intake module. A portion of the length of a perimeter margin of a shell, such as shell 64, is formed to have a channel 102 that runs along the margin. Channel 102 is bounded along each side by a respective ridge 104, 106. The margin of the shell is adapted for joining with a margin of another shell, such as shell 62. Joining is performed by a composite welding process, such as vibration welding.

The two shells are forced together along the portions of their margins that are to be joined, causing the edges of ridges 104, 106 to bear against the margin of the opposite shell. The shells are then subjected to a process that causes the edges of ridges 104, 106, and those portions of the opposite shell margin which the ridges are abutting, to fuse together, while retaining the cross sectional opening of channel 102. The intake module includes a feature at an appropriate location that provides for a fluid to enter the channel. After the fluid is conveyed through the channel, it exits through another feature at an appropriate location. For example, one feature can be a hole through a wall of one of the shells that registers with a hole in the engine when the intake module is assembled to the engine. The channel is suitable for allowing vacuum to be communicated to a hydrocarbon emission control valve, such as a PCV valve or a vapor purge flow valve, for sucking vapors through the channel.

While a presently preferred embodiment has been illustrated and described, it is to be appreciated that the invention may be practiced in various forms within the scope of the following claims.

What is claimed is:

1. An internal combustion engine intake module comprising:

composite elements forming at least a portion of an air intake system for an engine and a walled chamber of a PCV system for the engine;

a mounting receptacle for a PCV valve within the chamber;

a PCV valve disposed in the mounting within the chamber and comprising an inlet adapted to be communicated, via an entrance to the chamber, to a crankcase of the engine, and an outlet adapted to be communicated, via an exit from the chamber, to engine vacuum created when the engine is running; and a removable cap closing a through-hole in a wall of the chamber via which the PCV valve can be removed when the cap is removed from the through-hole;

in which the walled chamber is cooperatively defined by at least one composite element and a cover, and the through-hole that is closed by the cap is in the cover.

2. An internal combustion engine intake module as set forth in claim 1 in which the walled chamber is cooperatively defined by plural composite elements that cooperatively define a plenum and runners of the air intake system.

3. An internal combustion engine intake module as set forth in claim 1 in which the cap contains the mounting receptacle for the PCV valve.

4. An internal combustion engine intake module as set forth in claim 3 in which the at least one composite element comprises a formation capturing the PCV valve in the mounting receptacle.

5. An internal combustion engine intake module as set forth in claim 1 in which the at least one composite element contains the mounting receptacle for the PCV valve.

6. An internal combustion engine intake module as set forth in claim 5 in which the cap comprises a formation capturing the PCV valve in the mounting receptacle.

7. An internal combustion engine intake module as set forth in claim 1 in which the chamber further comprises a tortuous path forming an oil separator between the entrance to the chamber and the inlet of the PCV valve.

8. An internal combustion engine intake module comprising:

composite elements joined together to form at least a portion of an air intake system for an engine;

a first and a second of the composite elements being joined together along adjoining margins;

the adjoin ing margin of the first composite element comprising a channel bounded along its sides by respective ridges;

the ridges having edges that are fused with the adjoining margin of the second composite element to create an internal conduit within the module for conveying gaseous fluid; and an entrance to, and an exit from, the conduit spaced apart along the conduit length.

9. An internal combustion engine intake module as set forth in claim 8 including a hydrocarbon emission control valve communicated to the entrance and a source of engine vacuum communicated to the exit.

10. An internal combustion engine intake module as set forth in claim 8 including a vacuum-actuated utilization device communicated to the entrance and a source of engine vacuum communicated to the exit.

11. An internal combustion engine intake module as set forth in claim 8 in which the first and second composite elements comprise respective shells that fit together to enclose at least a portion of the air intake system, and the adjoining margins of the first and second composite elements comprise perimeter margins of the shells.

* * * * *